US010259026B2

(12) United States Patent
Dorigo et al.

(10) Patent No.: US 10,259,026 B2
(45) Date of Patent: Apr. 16, 2019

(54) ROLLING STAND AND CORRESPONDING METHOD

(71) Applicant: DANIELI & C. OFFICINE MECCANICHE SPA, Buttrio (UD) (IT)

(72) Inventors: Andrea Dorigo, Manzano (IT); Massimo Ferro, Mortegliano (IT); Luca Sandrin, Terzo di Aquileia (IT)

(73) Assignee: DANIELI & C. OFFICINE MECCANICHE SPA, Buttrio (UD) (IT)

( * ) Notice: Subject to any disclaimer, the term of this patent is extended or adjusted under 35 U.S.C. 154(b) by 349 days.

(21) Appl. No.: 15/190,933

(22) Filed: Jun. 23, 2016

(65) Prior Publication Data

US 2016/0375474 A1 Dec. 29, 2016

(30) Foreign Application Priority Data

Jun. 26, 2015 (IT) ..... 102015000028289

(51) Int. Cl.
*B21B 28/04* (2006.01)
*B08B 1/04* (2006.01)
(Continued)

(52) U.S. Cl.
CPC ..... *B21B 28/04* (2013.01); *A46B 13/02* (2013.01); *B08B 1/04* (2013.01); *B08B 1/02* (2013.01); *B21B 2003/001* (2013.01)

(58) Field of Classification Search
CPC ..... B21B 28/02; B21B 28/04; B08B 1/002; B08B 1/02; B08B 1/04; A46B 13/02
See application file for complete search history.

(56) References Cited

U.S. PATENT DOCUMENTS 3,379,044 A * 4/1968 Kirschner ..... B21B 28/04 72/236
3,603,125 A * 9/1971 Edwards ..... B21B 28/04 72/12.5
(Continued)

FOREIGN PATENT DOCUMENTS

JP 58-25806 A * 2/1983 ..... B21B 28/04
JP 06304615 11/1994
(Continued)

OTHER PUBLICATIONS

Translation, JP58-025806A, Feb. 1983.*
Search Report, issued in the corresponding Italian patent application No. UB20151696, dated Oct. 28, 2015, 10 pages.

*Primary Examiner* — Edward T Tolan
(74) *Attorney, Agent, or Firm* — Hamre, Schumann, Mueller & Larson, P.C.

(57) ABSTRACT

Rolling stand comprising a support structure, a rolling roll mounted on the support structure, and a cleaning unit of the rolling roll, comprising at least a brush and a positioning device for the brush. The positioning device comprises a support body on which the brush is installed, a pivoting member associated to the support body and around which the support body is selectively rotatable, an actuation member mounted on a support pin and associated to the support body in order to move it between an "inactive" position, in which the brush is not in contact with said rolling roll, and an "operating" position, in which the brush is in contact with the rolling roll.

12 Claims, 3 Drawing Sheets

(51) Int. Cl.

| | |
|---|---|
| ***A46B 13/02*** | (2006.01) |
| *B08B 1/02* | (2006.01) |
| *B21B 3/00* | (2006.01) |

(56) References Cited

U.S. PATENT DOCUMENTS

| | | | | |
|---|---|---|---|---|
| 4,015,307 | A * | 4/1977 | Kossak | B41F 35/00 101/425 |
| 4,852,209 | A | 8/1989 | Svenka et al. | |
| 5,086,701 | A * | 2/1992 | Gasparrini | B41F 35/06 101/423 |
| 5,228,190 | A * | 7/1993 | Sawa | B21D 39/021 29/243.57 |
| 5,531,090 | A | 7/1996 | Klein et al. | |
| 5,618,224 | A * | 4/1997 | Dumas | B21B 28/04 451/142 |
| 6,886,623 | B2 * | 5/2005 | Kato | B22D 11/0674 15/256.52 |
| 7,913,350 | B2 * | 3/2011 | Boecking | B21B 28/04 15/256.51 |

FOREIGN PATENT DOCUMENTS

| | | |
|---|---|---|
| JP | 2010184254 | 8/2010 |
| WO | 2008017412 | 2/2008 |

* cited by examiner

ROLLING STAND AND CORRESPONDING METHOD

FIELD OF THE INVENTION

The present invention concerns a rolling stand for metal products provided with at least a cleaning unit of a rolling roll, used for example for rolling flat products, such as metal strip or sheet. The rolling stand also comprises a positioning device provided to position the cleaning unit in predefined positions with respect to the rolling roll.

BACKGROUND OF THE INVENTION

It is known that in rolling stands for flat products, such as metal strip or sheet, in particular for delicate and high quality materials such as aluminum or suchlike, cleaning units are used, which comprise brushes for cleaning the surface of the rolling rolls.

The operation to clean the surface of the rolling rolls is carried out to prevent small residues of material, which remain adherent to the surfaces of the rolls, from causing defects in the flat metal products during rolling.

Indeed, such residues could cause unwanted marks such as impressions, furrows or scratches on the delicate metal materials like aluminum for example.

It is known that the brushes used for cleaning the surface of rolling rolls are not always kept in contact with the latter, but for practical reasons, for part of the time in which rolling is carried out, they remain in contact with the rolling roll, thus cleaning its surface.

Positioning devices for cleaning units for rolling rolls are known which, to take the brushes into contact with the rolling roll, or to distance them from it, use a mobile support body, such as for example a movable slide, on which a corresponding brush is mounted.

The movable slide is moved in a radial direction with respect to the rolling rolls, using one or more hydraulic actuators.

Positioning devices for cleaning units for rolling rolls are also known, for example that shown in U.S. Pat. No. 5,531,090, in which the brushes are mounted on a chock that supports a corresponding work roll while the movement device is a hydraulic actuator mounted inside the rolling stand, by driving which the brushes are moved nearer to/distanced from the rolling roll.

In such positioning devices for cleaning units for rolling rolls, the brushes can be positioned by radial or rotation movements in which their axis is displaced substantially parallel with respect to the axis of the rolling roll.

Furthermore, state-of-the-art positioning devices for cleaning units for rolling rolls use systems with many mechanical elements interacting with each other, which lead to strong plays being generated in the mechanisms, to the detriment of accuracy in positioning.

The assembly of state-of-the-art positioning devices for cleaning units for rolling rolls, in particular in the solution with a radially movable slide, requires inevitable plays between the support frame of the brushes and the corresponding guides.

Such plays cause vibrations in the part of the mobile support that lead to consequent vibrations of the brush as well.

One disadvantage due to the vibrations of the brush is the marking of the rolling roll, which can cause consequent signs and marking in the surface of the rolled product, which is even more accentuated as the wear progresses on the support frame of the brushes and the corresponding guides.

Another disadvantage of state-of-the-art positioning devices for cleaning units for rolling rolls is due to their excessive size and bulk, which do not allow easy installation and make the maintenance operations of the rolling stands more difficult.

Another disadvantage is that known positioning devices are not easily adaptable to different positions of the brush, which can be required to adapt the cleaning steps to the progressive wear of the rolling rolls due to friction between the surfaces and/or due to a grinding operation.

Other examples of cleaning units for rolling rolls are described in WO-A-2008/017412, JP-A-2010.184254, JP-A-H06.304615 and U.S. Pat. No. 4,852,209.

For example, WO-A-2008/017412 describes cleaning rolls for rolling rolls, for hot rolling aluminum. In this known solution, a brush is installed on a support body. The support body and the brush are moved by a hydraulic cylinder through a transmission element and an adjustment element. The hydraulic cylinder is pivoted around a pin. However, this solution does not allow to overcome the disadvantages described above.

There is therefore a need to perfect a rolling stand comprising a cleaning unit of a rolling roll that can overcome at least one of the disadvantages of the state of the art.

In particular, one purpose of the present invention is to obtain a cleaning unit that is compact and therefore not bulky inside the rolling stand.

Another purpose of the present invention is to perfect a rolling stand provided with a positioning device that allows to reduce, or even eliminate, the vibrations transmitted to the brush.

Another purpose of the present invention is to obtain a rolling stand in which the cleaning unit is positioned precisely, reliably and long-lastingly.

Another purpose of the present invention is to obtain a rolling stand in which the cleaning unit is practical and efficient.

Another purpose of the present invention is to obtain a rolling stand that is easy to adjust, to adapt to variable circumferences of the rolling rolls, also as a consequence of the progressive wear during working.

Moreover, one purpose of the present invention is to obtain a rolling stand with a positioning device that is simple and economical.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, a rolling stand according to the present invention comprises a support structure, or chock, a rolling roll mounted on the support structure, and a cleaning unit of the rolling roll.

The cleaning unit of the rolling roll comprises a brush and a positioning device installed on a support structure on which the respective rolling roll is also installed.

According to some embodiments of the present invention, the positioning device comprises at least one support body on which the brush is installed and at least one pivoting member associated to the support body and around which the support body is selectively rotatable.

According to some embodiments of the present invention, the positioning device also comprises an actuation member mounted on a support pin and associated to the support body in order to move it between an "inactive" position, in which the brush is not in contact with the rolling roll, and an "operating" position, in which the brush is in contact with the rolling roll.

According to one embodiment of the present invention, both the pivoting member on which the support body rotates and the corresponding brush, and the support pin of the actuation member, are associated to the support structure so that the support body and the actuation member are both kept on the support structure.

This solution allows to obtain an extremely compact positioning device for a cleaning unit, which is not bulky inside the rolling stand; thanks to its limited size and the assembly of all the components on the same element that also supports the rolling roll, it allows to minimize the play between the various elements of which it consists.

Furthermore, the compactness of the positioning device allows to reduce to a minimum the vibrations transmitted to the brush, thus avoiding ruining the respective rolling roll and consequently the rolled product being worked.

According to one aspect of the present invention, the actuation member of the positioning device comprises first travel limitation means to define the position in which the brush is not in contact with the respective rolling roll and second travel limitation means to define the position in which the brush is in contact with the respective rolling roll and cleans it.

According to another aspect of the present invention, the actuation member comprises at least one adjustment member suitable to adapt the movement of the positioning device to variable diameters of the rolling roll.

The present invention also concerns a method for positioning a cleaning unit to take a brush, associated to a support body, selectively into contact with a rolling roll in order to clean it. The rolling roll is installed on a support structure.

The method provides:

- to extend an actuation member associated to a support pin and to a connection pin so as to make the support body rotate around a pivoting member, bringing the brush nearer to the rolling roll so as to obtain contact and carry out the cleaning thereof, keeping both the support body and the actuation member on a support structure, the pivoting member and the support pin being associated to the support structure;
- to compress the actuation member so as to make the support body rotate around the pivoting member in an opposite direction, distancing the brush from the rolling roll so as to obtain the separation and disengagement of the brush from the rolling roll.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
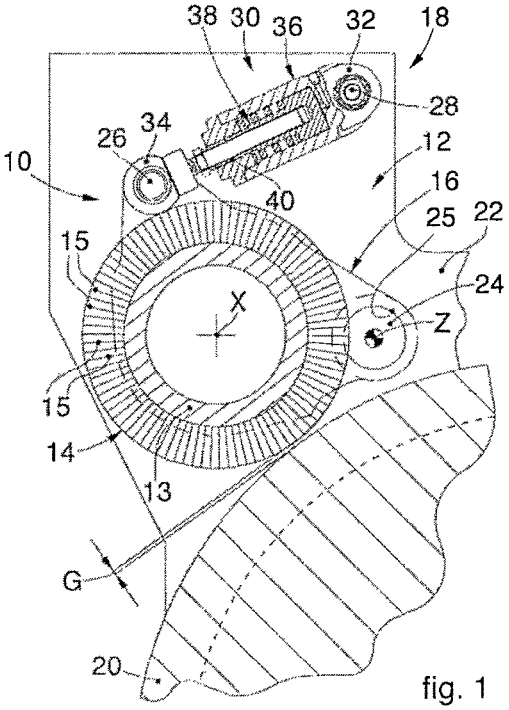
FIG. 1 is a cross section of a rolling stand with a cleaning unit of a rolling roll in a first operating condition, according to embodiments described here.

With reference to FIG. 1, this is used to describe example embodiments of a cleaning unit 12 for a rolling roll 20, used in a rolling stand 18.

According to variants, the cleaning unit 12 can be used in a rolling stand 18 used for rolling flat metal products, like strip or sheet.

According to other variants, the cleaning unit 12 can be used in a rolling stand 18 for rolling flat metal products made, by way of example, of aluminum.

The rolling stand 18 can be provided with at least a support structure 22, such as for example a chock, to support and allow the movement of the respective rolling roll 20.

According to variants, at least one cleaning unit 12 can be provided for each rolling roll 20.

According to variants, both the at least one cleaning unit 12 and the corresponding rolling roll 20 can both be installed on the same support structure 22.

According to variants described using FIG. 1, the cleaning unit 12 can comprise at least a positioning device 10 and at least one brush 14 of the rotary type.

According to variants, the brush 14 can comprise at least one support shaft 13 and a plurality of bristles 15.

According to other variants, the bristles 15 can be attached on the perimeter of the support shaft 13, for example to form a sunburst structure.

The positioning device 10 is configured to take the at least one brush 14, when required, into contact with the surface of the rolling roll 20 and to retract it when contact is no longer needed.

Furthermore, the positioning device 10 can comprise at least one support body 16 and at least one actuation member 30, connected to it.

According to variants, the actuation member 30 can be a linear actuator for example.

According to other variants, the actuation member 30 can be a single-effect linear actuator for example.

The brush 14 can be installed on the support body 16, which in this case is a flange with a approximately triangular shape, and can be idle, being activated to rotate around an axis of rotation X by the motion of the rolling roll 20, when it is brought close to the latter.

According to variants, the axis of rotation X of the at least one brush 14 is substantially parallel to the axis of rotation of the respective rolling roll 20.

The brush 14 can also be installed on the support body 16 and be activated to rotate around its axis of rotation X by an actuation unit, by way of example a motor (not shown in the drawings).

The brush 14 can be made to rotate by the actuation unit when it is in contact with the rolling roll 20, or preferably a moment before contact.

The brush 14 can be made to rotate in the same direction as the direction of rotation of the respective rolling roll 20 to accentuate and improve the removal of possible small residues of material that have remained adherent to the surface of the latter.

The brush 14 can be made to rotate in the opposite direction from the direction of rotation of the respective rolling roll 20.

According to variants, the support structure 22 can comprise a pivoting member 24, to which the support body 16 is connected; the pivoting member 24 determines the assembly of the support body 16 and hence the brush 14 on the support structure 22 of the rolling roll 20, for example a chock.

According to other variants, the support body 16 can comprise an eyelet 25.

The connection of the support body 16 to the pivoting member 24 can be obtained by inserting the pivoting member 24 into the eyelet 25 made in the support body 16.

Furthermore, the reciprocal positioning of the eyelet 25 and the pivoting member 24 can allow to rotate the support body 16 with respect to an axis of rotation Z, which is substantially parallel to the axis of rotation X of the brush 14.

According to variants, the positioning of the pivoting member 24 and the eyelet 25 could also be inverted and the same functions maintained, that is, by providing the support body 16 comprising the pivoting member 24 and the support structure 22 comprising the eyelet 25.

The rotation of the support body 16 with respect to the axis of rotation Z can allow to move the brush 14 toward/away from the rolling roll 20.

According to variants, a cantilevered pin 28 can be attached on the support structure 22, to which pin 28 the actuation member 30 is connected.

According to other variants, the actuation member 30 can comprise a first coupling 32.

The connection of the actuation member 30 to the cantilevered pin 28 can be obtained by inserting the cantilevered pin 28 into the first coupling 32 of the actuation member 30.

According to variants, the support body 16 can comprise a connection pin 26 to which the actuation member 30 is connected.

According to other variants, the actuation member 30 can comprise a second coupling 34.

The connection of the actuation member 30 to the support body 16 can be obtained by inserting the connection pin 26 into the second coupling 34 of the actuation member 30.

The reciprocal positioning of the second coupling 34 and the connection pin 26 can allow to move the support body 16 by means of the actuation member 30.

Moreover, the reciprocal positioning of the first coupling 32 and the cantilevered pin 28 can allow the actuation member 30 to rotate, in order to also allow the support body 16 to rotate with respect to the axis of rotation Z, and hence allow the brush 14 to move toward/away from the rolling roll 20, according to the condition of the actuation member 30, respectively extended or compressed.

Figure 9:
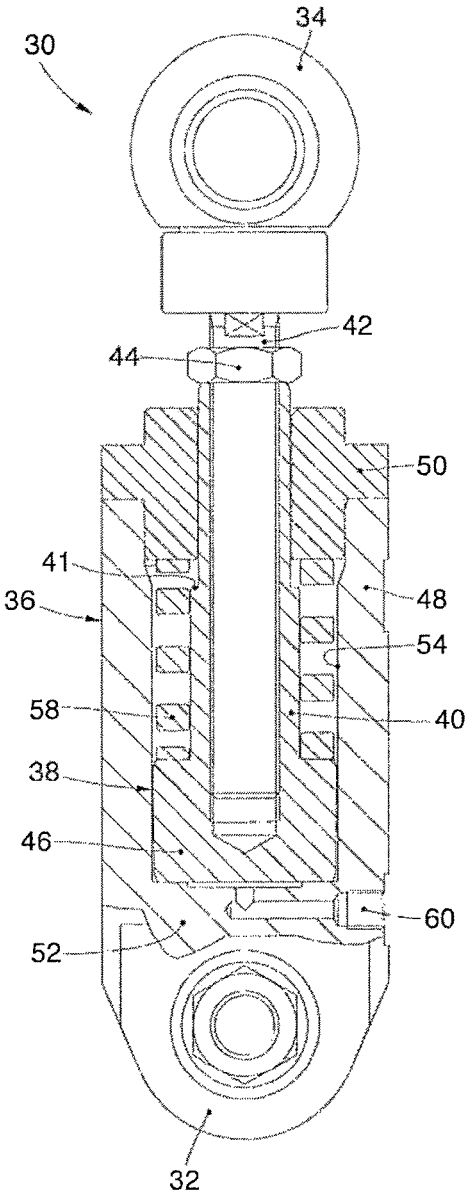
FIG. 9 is a cross section of a detail of a positioning device for a cleaning unit of a rolling roll, according to other embodiments described here.

According to variants described using FIG. 9, the actuation member 30 can comprise a cylinder 36 and a piston 38, which slides inside the cylinder 36, which acts as a guide and establishes the travel thereof.

According to variants, the cylinder 36 can comprise a jacket 48, a head 50 and a bottom 52.

The jacket 48 identifies a central body, delimited at its two ends respectively by the head 50 and the bottom 52, inside which the piston 38 can slide.

Furthermore, the cylinder 36 comprises at least a chamber 54 defined by the jacket 48, head 50 and bottom 52.

According to variants, the piston 38 can comprise a plunger 46 and a rod 40.

The actuation member 30 can also comprise at least an elastic element 58.

The elastic element 58 can be positioned inside the cylinder 36 and be coaxial with the piston 38.

The elastic element 58 can be for example wound and ringed on the rod 40, delimited externally by the jacket 48, and can be positioned so as to press on one side against the head 50 and on the other side against the plunger 46.

The elastic element 58 can be provided pre-compressed, so as to keep the plunger 46 pressed with a certain force toward the bottom 52, when the actuation member 30 is not driven.

An elastic element 58 suitable for the purpose can be, for example, a helical spring.

Figure 3:
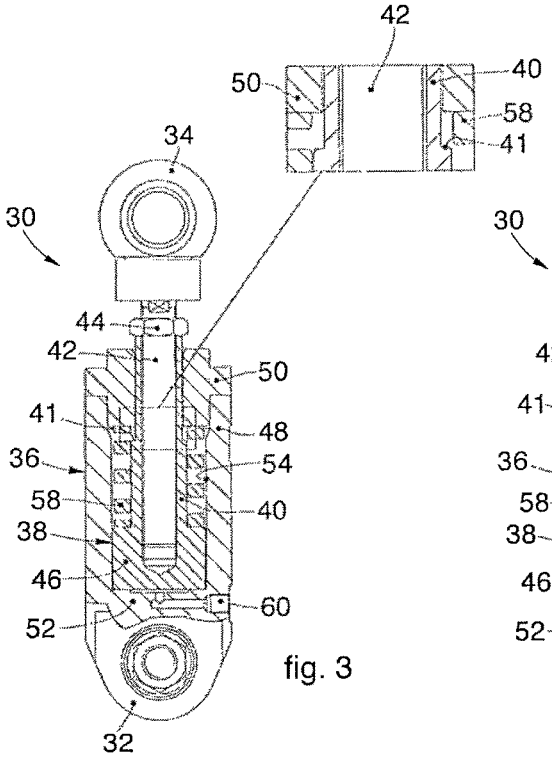
FIG. 3 is a cross section with corresponding enlargement of a detail in FIG. 1.

According to variants described using FIGS. 1 and 3, the cleaning unit 12 is in an "inactive" position, in which the piston 38 is kept close up to and in contact with the bottom 52, and the actuation member 30 is therefore configured compressed.

The geometry that is established between the actuation member 30 and the support body 16 is designed so as not to allow the brush 14 to come into contact with the rolling roll 20.

By "inactive" position we mean a position in which the bristles 15 of the brush 14 do not interfere with the respective rolling roll 20, since they are not in contact with its surface, but define a gap G with respect to it and therefore do not perform any cleaning operations of possible residual material on the surface of the rolling roll 20.

According to variants, the actuation member 30 can comprise an entrance 60 that puts the external part of the cylinder 36 into communication with the chamber 54.

By means of the entrance 60 it is possible to insert pressurized liquid, for example mineral oil, so as to be able to drive the plunger 46, making it slide inside the chamber 54 toward the head 50.

The pressure of the liquid inserted through the entrance 60 must produce a force such as to be at least higher than the resistance opposed by the elastic force of the elastic element 58, so as to be able to compress the latter.

Driving the plunger 46 leads to a travel of the rod 40 outside the cylinder 36, which causes an extension of the actuation member 30, leading to an increase in the distance between the first coupling 32 and the second coupling 34.

According to variants, the rod 40 can include a notch 41, or shoulder, configured to delimit at least a condition of maximum travel toward the outside of the rod 40 with respect to the cylinder 36. In the condition of maximum travel toward the outside of the rod 40, the notch 41 rests against the head 50, thus defining a stable positioning of the whole cleaning unit 12 also with respect to the vibrations that can be generated.

The travel of the rod 40 can be limited to a predetermined value according to the position of the notch 41.

The physical obstacle defined by the notch 41 allows the rod 40 a maximum travel equal to the distance between the notch 41 and the head 50 when the actuation member 30 is in the "inactive" position, or not driven.

Figure 2:
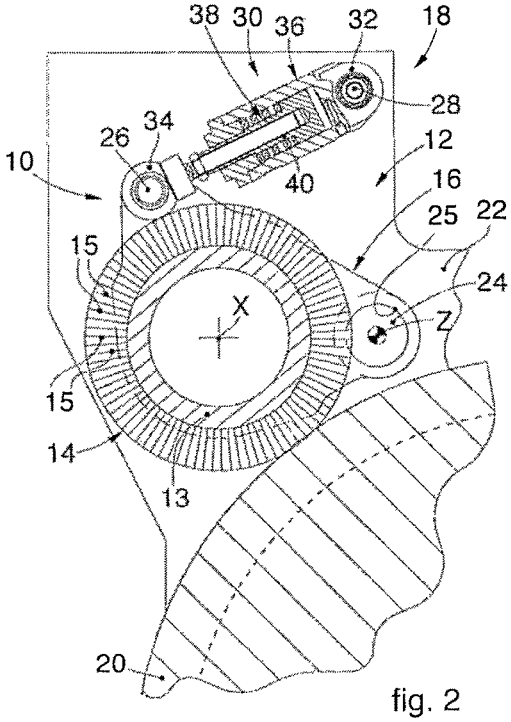
FIG. 2 is a cross section of a rolling stand with a cleaning unit of a rolling roll in a second operating condition, according to embodiments described here.
Figure 4:
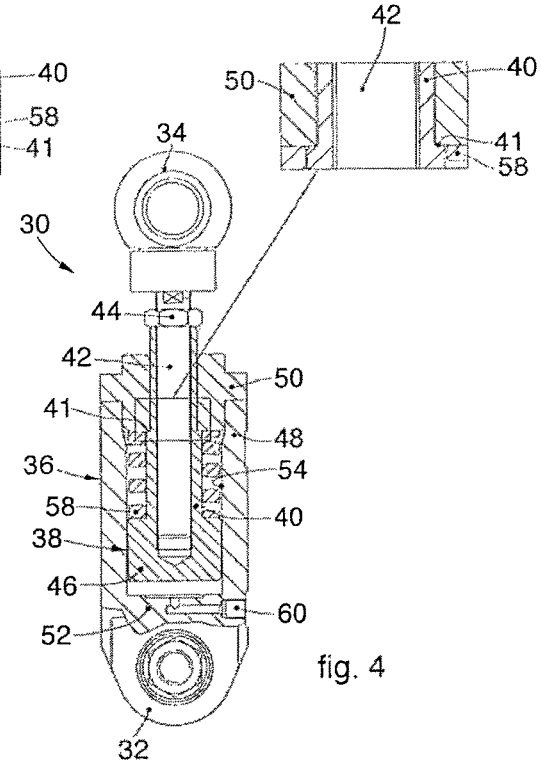
FIG. 4 is a cross section with corresponding enlargement of a detail in FIG. 2.

According to variants described using FIGS. 2 and 4, the cleaning unit 12 is in an "operating" position, in which the piston 38 has been driven to take the notch 41 of the rod 40 into contact with the head 50, the actuation member 30 therefore being configured in its maximum extension.

The geometry that is established between the actuation member 30 and the support body 16 is designed to allow the brush 14 to come into contact with the rolling roll 20.

By "operating" position we mean a position in which the bristles 15 of the brush 14 interfere with the respective rolling roll 20, since they are in contact with it, advantageously so as to slightly overlap the sunburst structure defined by the bristles 15 over the rolling roll 20 and therefore perform the operations to clean possible residual material on the surface of the rolling roll 20.

When it is no longer necessary to clean the rolling rolls 20, the cleaning unit 12 can be returned to its "inactive" position.

To obtain the return to the "inactive" position of the cleaning unit 12, the actuation member 30 can be activated in an inverse manner to the one described above, reducing the pressure of the liquid in the entrance 60, thus reducing the force acting on the plunger 46 so that the elastic force of the elastic element 58 overcomes it, returning the plunger 46 into contact with the bottom 52.

According to variants, following the progressive wear on the rolling rolls 20 due to the continual friction between them and the metal strip or sheet being rolled, or following a grinding operation, a considerable reduction in their diameter can occur, not allowing the brush 14 to come into contact with the respective rolling roll 20 even when the cleaning unit 12 is in the "operating" position.

For this reason, it may be necessary to adapt the extension of the actuation members 30.

According to variants, the actuation member 30 can comprise an adjustment tie-rod 42 and a clamping element 44.

According to variants, the adjustment tie-rod 42 can be coaxial with the rod 40 and can be selectively insertable into/removable from it, for example able to be screwed in/out.

According to variants, the clamping element 44 can be a clamping nut for example.

Figure 5:
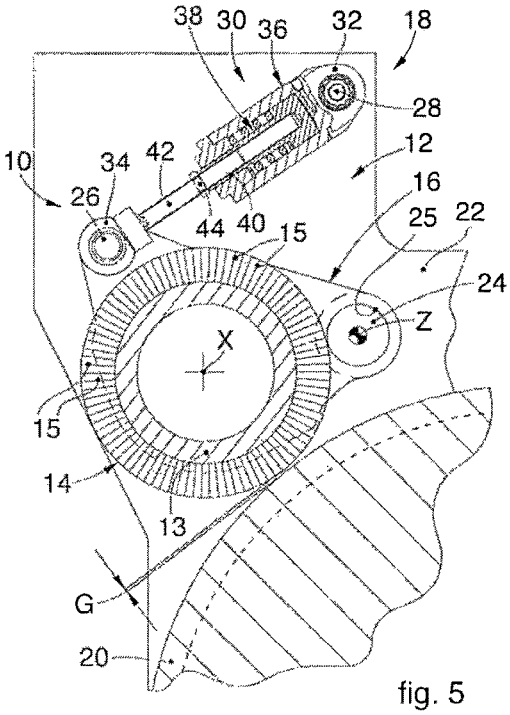
FIG. 5 is a cross section of a rolling stand with a cleaning unit of a rolling roll in a third operating condition, according to embodiments described here.
Figure 6:
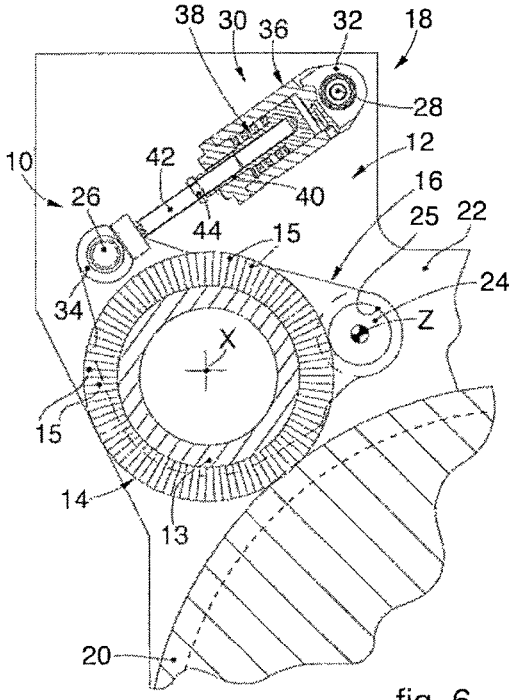
FIG. 6 is a cross section of a rolling stand with a cleaning unit of a rolling roll in a fourth operating condition, according to embodiments described here.

According to variants described using FIGS. 5 and 6, when the sizes of the rolling roll 20 are reduced for the reasons explained above, it becomes necessary to reduce the diameter of the rolling roll 20, modifying the travel of the adjustment tie-rod 42 with respect to the rod 40.

According to variants described using FIG. 6, it may be useful to increase the length of the actuation member 30 so as to drive the support body 16 in order to allow the brush 14 to come into contact with the rolling roll 20 with the same entity of overlapping between the sunburst of the bristles 15 and the rolling roll 20 in the case of rolling rolls 20 that are not worn (see FIG. 2).

Figure 7:
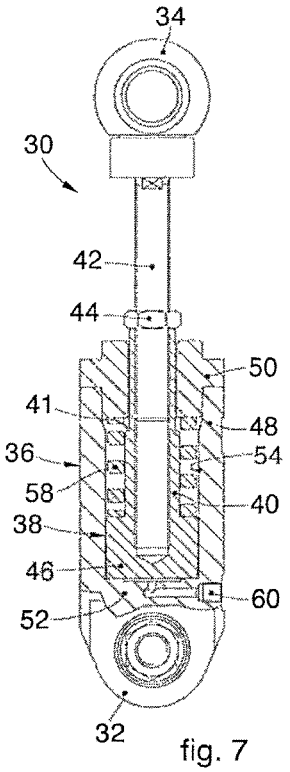
FIG. 7 is a cross section of a detail of FIG. 5.

According to variants described using FIGS. 5 and 7, the cleaning unit 12 is in an "inactive" position, in which the piston 38 is kept close to and in contact with the bottom 52, and the actuation member 30 is therefore configured compressed.

The reduction in the diameter of the rolling roll 20 can therefore be recovered by unscrewing the adjustment tie-rod 42 from the shaft 40 and, when the desired position is reached, it is possible to clamp the adjustment tie-rod 42 in said position by tightening the clamping element 44.

Figure 8:
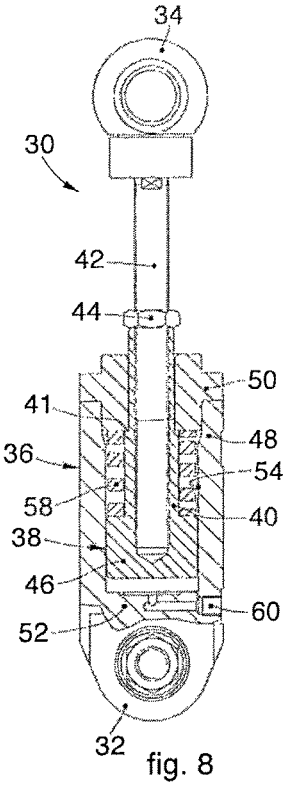
FIG. 8 is a cross section of a detail of FIG. 6.

According to variants described using FIGS. 6 and 8, the cleaning unit 12 is in an "operating" position in which the piston 38 has been driven to take the notch 41 of the rod 40 into contact with the head 50, and the actuation member 30 is therefore configured at its maximum extension.

The geometry that is established between the actuation member 30 and the support body 16 is designed so as to allow the brush 14 to come into contact with the rolling roll 20, thus performing the cleaning operations as described before with regard to the non-worn condition of the rolling roll 20.

When it is no longer necessary to clean the rolling rolls 20, the cleaning unit 12 can be returned to the "inactive" position.

Figure 10:
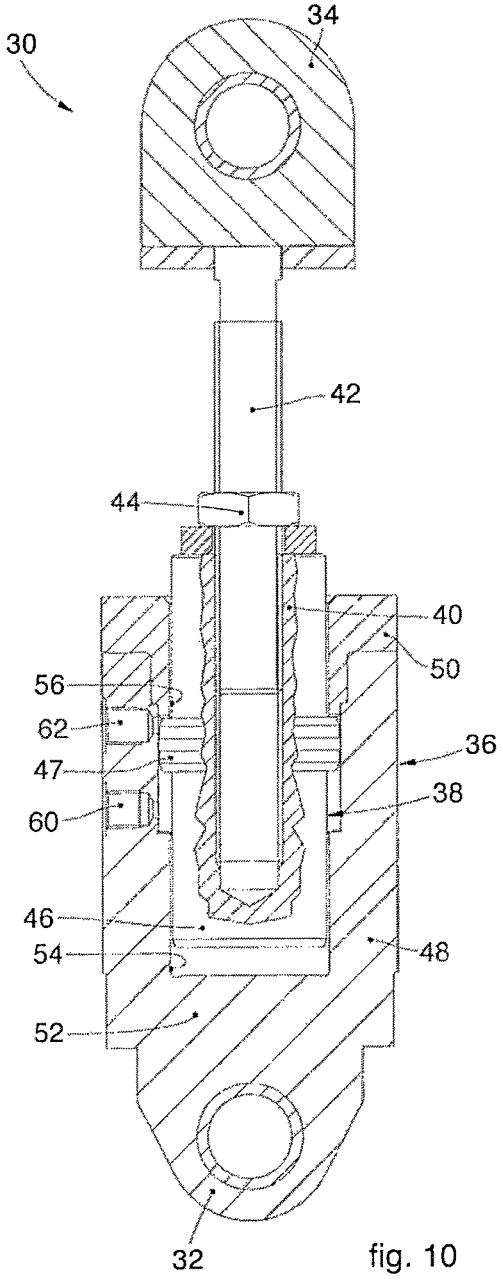
FIG. 10 is a cross section of a detail of a positioning device for a cleaning unit of a rolling roll, according to other embodiments described here.

According to variants described using FIG. 10, the actuation member 30 can be a double-effect linear actuator for example.

According to variants, the actuation member 30 can comprise a second chamber 56 and a second entrance 62.

According to variants, the second entrance 62 of the actuation member 30 puts the external part of the cylinder 36 into communication with the second chamber 56.

According to variants, the actuation member 30 can comprise sealing elements 47.

The separation between the chamber 54 and the second chamber 56 can be defined by the sealing element 47 associated with the plunger 46, which can be, for example, sealing packings.

By means of the entrance 60 and the second entrance 62 it is possible to insert pressurized liquid, for example mineral oil, so as to drive the plunger 46.

If the pressure of the liquid inserted from the entrance 60 is greater than the pressure of the liquid inserted from the second entrance 62, then there can be a movement of the plunger 46 toward the head 50 of the actuation member 30, or if the plunger 46 has already reached the head 50, it is kept in contact with the latter.

On the contrary, if the pressure of the liquid inserted from the second entrance 62 is greater than the pressure of the liquid inserted from the entrance 60, then there can be a movement of the plunger 46 toward the bottom 52 of the actuation member 30, or if the plunger 46 has already reached the bottom 52, it is kept in contact with the latter.

In this case, the passage of the cleaning unit 12, by driving the positioning device 10, from the "inactive" position to the "operating" position can be selectively obtained by varying the pressure of the liquid inside the chamber 54 or second chamber 56.

It is clear that modifications and/or additions of parts may be made to the rolling stand 18 as described heretofore, without departing from the field and scope of the present invention.

It is also clear that, although the present invention has been described with reference to some specific examples, a person of skill in the art shall certainly be able to achieve many other equivalent forms of rolling stand 18, having the characteristics as set forth in the claims and hence all coming within the field of protection defined thereby.

The invention claimed is:

1. A rolling stand comprising:

a support structure;

a rolling roll mounted on said support structure;

a cleaning unit of said rolling roll, the cleaning unit includes a brush and a positioning device for said brush, said positioning device includes:

at least one support body on which said brush is installed, at least one pivoting member associated to said support body and around which said support body is selectively rotatable, at least one actuation member mounted on a support pin and associated to said support body in order to permit said actuation member to move between an inactive position, in which said brush is not in contact with said rolling roll, and an operating position, in which said brush is in contact with said rolling roll, wherein said pivoting member and said support pin are associated to said support structure so that said support body and said actuation member are both kept on said support structures;

said actuation member includes a cylinder and a piston selectively movable inside said cylinder;

said piston includes a plunger and a rod sliding with respect to the cylinder, said rod includes a notch configured to delimit at least a condition of maximum travel toward an outside of said rod with respect to said cylinder.

2. The rolling stand as in claim 1, wherein said actuation member comprises a first coupling to be associated to said support structure and a second coupling to be associated to said support body.

3. The rolling stand as in claim 1, wherein said actuation member comprises a bottom to interfere with the piston and to define the inactive position of said actuation member and a head to interfere with the piston and to define the operating position of said actuation member.

4. The rolling stand as in claim 3, wherein, in the condition of maximum travel of the rod toward the outside, said notch is located resting against said head.

5. The rolling stand as in claim 1, wherein said actuation member comprises an adjustment tie-rod with which to selectively modify extension of said actuation member.

6. The rolling stand as in claim 5, wherein said actuation member comprises a clamping element with which to clamp said adjustment tie-rod in a set position.

7. The rolling stand as in claim 1, wherein said actuation member is a single-effect linear actuator comprising a chamber communicating with an outside of said actuation member by means of an entrance.

8. The rolling stand as in claim 7, wherein said actuation member comprises an elastic element that biases said actuation member toward the inactive position.

9. The rolling stand as in claim 8, wherein said elastic element is a spring.

10. The rolling stand as in claim 1, wherein said actuation member is a double-effect linear actuator comprising a first chamber and a second chamber in which said first chamber is communicating with an outside of said actuation member by means of an entrance and in which said second chamber is communicating with the outside of said actuation member by means of a second entrance.

11. The rolling stand as in claim 1, wherein said brush comprises a support shaft and a plurality of bristles attached peripherally to said support shaft.

12. A method for positioning a cleaning unit to take a brush, associated to a support body, selectively into contact with a respective rolling roll, said rolling roll being mounted on a support structure, said method comprises:

extending an actuation member associated to a support pin and to a connection pin so as to make said support body rotate around a pivoting member, bringing said brush nearer to said rolling roll so as to obtain contact and carry out cleaning of said rolling roll, keeping both said support body and said actuation member on said support structure, said pivoting member and said support pin being associated to said support structure, said actuation member includes a cylinder and a piston selectively movable inside said cylinder, said piston includes a plunger and a rod sliding with respect to the cylinder, said rod includes a notch configured to delimit at least a condition of maximum travel toward an outside of said rod with respect to said cylinder;

compressing said actuation member so as to make said support body rotate around said pivoting member in an opposite direction, distancing said brush from said rolling roll so as to obtain separation and disengagement of said brush from said rolling roll.

* * * * *